US005656237A

United States Patent [19]

Terrien et al.

[11] Patent Number: 5,656,237

[45] Date of Patent: Aug. 12, 1997

[54] RESULFURIZED AUSTENITIC STAINLESS STEEL WITH IMPROVED MACHINABILITY

[75] Inventors: Pascal Terrien; Xavier Cholin, both of Albertville; Pierre Pedarre, Annecy, all of France

[73] Assignee: Ugine Savoie, Ugine, France

[21] Appl. No.: 629,228

[22] Filed: Apr. 8, 1996

[30] Foreign Application Priority Data

Apr. 7, 1995 [FR] France ..... 95 04140

[51] Int. Cl.[6] ..... C22C 38/42; C22C 38/60

[52] U.S. Cl. ..... 420/41; 420/42

[58] Field of Search ..... 420/41, 42

[56] References Cited

U.S. PATENT DOCUMENTS

| | | | |
|---|---|---|---|
| 5,089,224 | 2/1992 | Bletton et al. | 420/41 |
| 5,362,439 | 11/1994 | Bletton et al. | 420/41 |

FOREIGN PATENT DOCUMENTS

| | | |
|---|---|---|
| 0 257 979 | 3/1988 | European Pat. Off. . |
| 0 403 332 | 12/1990 | European Pat. Off. . |
| 1319652 | 12/1989 | Japan . |
| 4041651 | 2/1992 | Japan . |
| 5339680 | 12/1993 | Japan . |
| 346 813 | 7/1972 | Sweden . |

OTHER PUBLICATIONS

French Search Report Dated Nov. 14, 1995.

*Primary Examiner*—Deborah Yee

*Attorney, Agent, or Firm*—Oblon, Spivak, McClelland, Maier & Neustadt, P.C.

[57] ABSTRACT

The present invention relates to a resulfurized austenitic stainless steel with improved machinability, and which is especially useful in the field of machining at high cutting speed and in the field of bar turning.

7 Claims, 2 Drawing Sheets

RESULFURIZED AUSTENITIC STAINLESS STEEL WITH IMPROVED MACHINABILITY

BACKGROUND OF THE INVENTION

1. Field of the Invention

The present invention relates to a resulfurized austenitic stainless steel with improved machinability. This steel may be used in the field of machining at high cutting speed, in the field of bar turning, etc.

2. Discussion of the Background

For one skilled in the art, it is understood that high-speed machining of austenitic stainless steels means the use of cutting speeds greater than 500 m/min. The speeds which can be used on a steel are, for example, determined by turning tests with tools having coated-carbide tips, which tests, designated $Vb_{15/0.15}$, consist in determining the speed for which the flank wear is 0.15 mm after machining for 15 minutes. Above this speed, it is not possible to machine without risk, while below this speed, machining on an industrial scale is possible.

A resulfurized austenitic stainless steel with improved machinability is known from European Patent No. 403,332, incorporated herein by reference. This document describes a process in which it is proposed, in order to improve the machinability, to introduce, into a steel having the following general composition:

less than 0.15% of carbon, less than 2% of silicon, less than 2% of manganese, less than 3% of molybdenum, between 7 and 12% of nickel and between 15 and 25% of chromium, a quantity of sulfur in a proportion lying between 0.1 and 0.4% and associated with calcium and oxygen having contents greater than $30\times10^{-4}$% and $70\times10^{-4}$%, respectively, the calcium and oxygen contents being such that the Ca/O ratio is between 0.2 and 0.6.

In this document, the desired aim is the formation, with manganese and, in a lower proportion, with chromium, of a manganese chromium sulfide (Mn,Cr)S which, in the form of specific inclusions, causes solid lubrication of the cutting tool during machining operations.

It is also specified that sulfur has an unfavorable effect on corrosion resistance but that, despite this, a chosen aim is to introduce, into a resulfurized steel, inclusions of aluminosilicate oxides of lime which are usually associated with inclusions of sulfides.

Such an austenitic steel has good machinability properties in the conventional range of cutting speeds, that is to say less than 500 m/min in turning. The steel has associated inclusions composed of aluminosilicate-type oxides which preferentially coat sulfide inclusions. These inclusions are larger and more deformable than sulfide-only inclusions. The effect of the so-called solid lubrication of the cutting tool is improved thereby. However, the steel described in the cited document has a drawback. This is because sulfur reduces the properties of the steel from the standpoint of cold deformation, stress cracking, etc., for example when drawing or wire-drawing.

SUMMARY OF THE INVENTION

One object of the present invention is to provide a steel with improved machinability and which can be used, for example, in the field of high-speed machining, with turning cutting speeds exceeding 500 and even 700 m/min, in the field of bar turning, etc., with 30% higher productivities than those obtained with an ordinary resulfurized austenitic stainless steel.

DETAILED DESCRIPTION OF THE INVENTION

The above object of the invention is provided by a resulfurized austenitic stainless steel with improved machinability, useful especially in the field of machining at high cutting speed and in the field of bar turning, the composition by weight of which preferably is as follows (based on total weight):

carbon<0.1% silicon<2% manganese<24 nickel, from 7 to 12% chromium, from 15 to 25% sulfur, from 0.10 to 0.55% copper, from 1 to 5% calcium>$35\times10^{-4}$% oxygen>$70\times10^{-4}$%, the ratio of calcium to oxygen (Ca/o) preferably being between 0.2 and 0.6, including 0.3, 0.4 and 0.5, and the remainder preferably being iron and inevitable impurities resulting from production.

Other preferred characteristics of the invention include:

a sulfur content of between 0.20 and 0.40, more preferably between 0.25 and 0.35%;

a copper content between 1.2 and 3, more preferably between 1.4 and 1.8%, the composition comprises less than 3% molybdenum.

These preferred characteristics may be present alone or in any combination.

The description which follows and the appended figures, all given by way of non limiting example, will make the invention more clearly understood.

Figure 1:
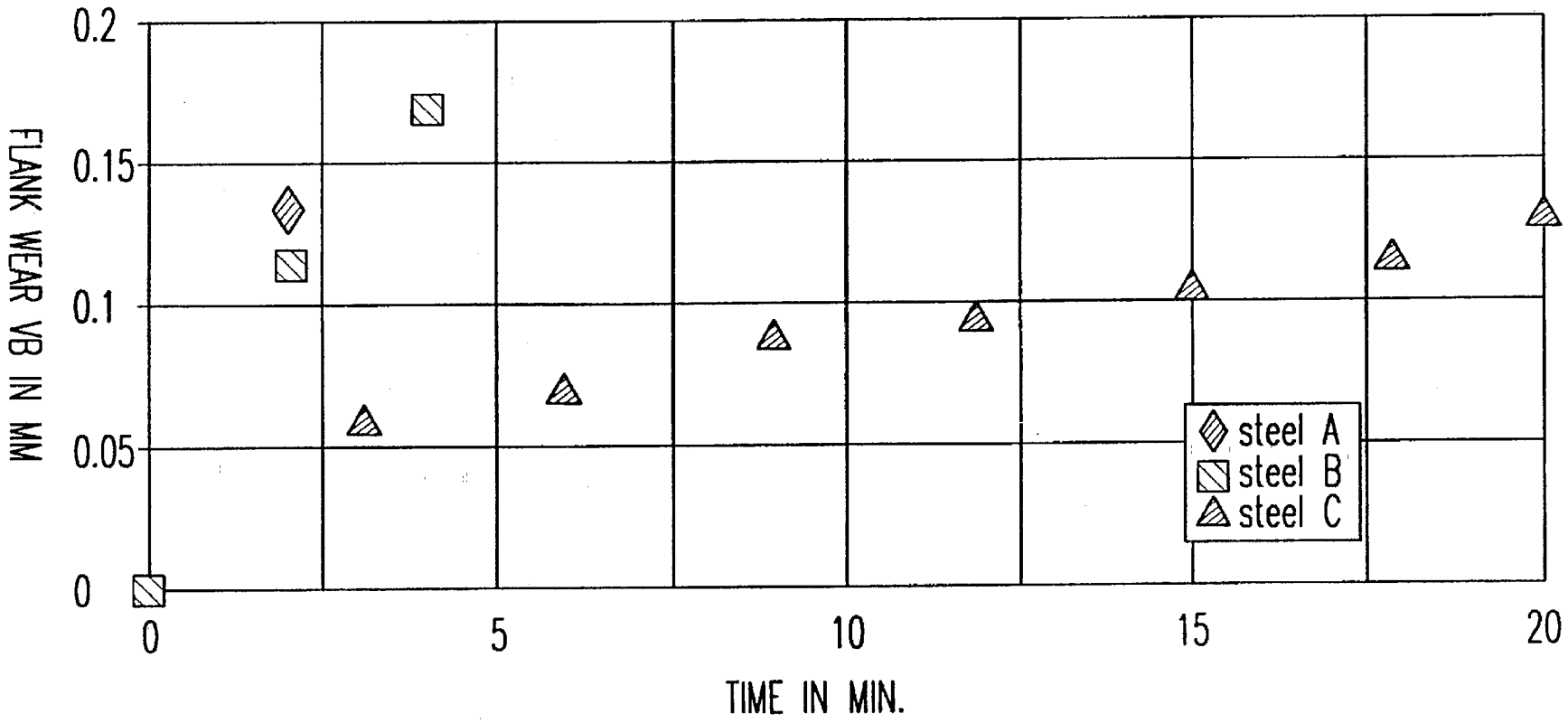
FIG. 1 shows the flank wear curves of resulfurized stainless steels either without any copper or without any inclusions of aluminosilicate of lime and of a resulfurized steel according to the invention, these steels being machined at a high cutting speed.

The austenitic stainless steel according to the invention preferably has the following composition by weight: less than 0.1% of carbon, less than 2% of silicon, less than 2% of manganese, from 7 to 12% of nickel, from 15 to 25% of chromium, from 0.10 to 0.55% of sulfur, from 1 to 5% of copper, greater than $35\times10^{-4}$% of calcium and greater than $70\times10^{-4}$% of oxygen, the ratio of the calcium content to the oxygen content being between 0.2 and 0.6. Preferably, the balance is iron and inevitable impurities.

The invention steel falls within the field of so-called resulfurized steels of which the sulfur content and, in a defined ratio, the calcium and oxygen content, ensure that said steels have good machinability at all cutting speeds including those of less than 500 m/min.

In the use of the steel according to the invention within the field of machining at high cutting speed, machinability is improved, it is thought, by the combined effect of a large number of inclusions, these being manganese sulfides and aluminosilicate oxides of lime arising from the addition of both calcium and oxygen, and by the presence of copper. Copper is believed to lower the stresses necessary to form a chip. Because of this property, the temperature at the tip of the tool remains at a level which can be withstood by the tip. Under these conditions, the many inclusions of manganese sulfide and aluminosilicate oxides of lime are believed to fully ensure, in combination, their role of solid lubricant in retarding tool wear.

In the steel according to the invention, the manganese sulfides are only very slightly substituted with chromium because of a manganese content adapted to the sulfur content, their malleability and therefore their effectiveness during cutting being improved thereby. Sulfur may be partially (1–50%) replaced by selenium and/or tellurium.

The resulfurized steel according to the invention, which can preferably be used in the field of so-called machining at high cutting speeds, by virtue of the presence of a large number of malleable low-melting point sulfide and associated or unassociated oxide inclusions and by virtue of the presence of a copper content according to the invention, ensures, on the one hand, that the machining can be performed at exceptional cutting speeds and, on the other hand, that the lifetime of the cutting tool is preserved.

EXAMPLES

In a comparative machinability test at high cutting speed, that is to say greater than 500 m/min, a TiN-coated carbide tool is used. The change in flank wear of the tool during the machining of three resulfurized steels, A, B and C, was compared. Steels A and B are resulfurized reference steels, steel A containing no calcium or oxygen in a preferred proportion, steel B containing low copper in its composition. Steel C, according to the invention, in this application example, includes in its composition 1.5% of copper, $44\times10^{-4}$% of calcium and $118\times10^{-4}$% of oxygen. The compositions of reference steels A and B and steel C according to the invention are given in more detail in wt % in the table below as well as the compositions of steels D and E to be discussed later, where Ca and O are $\times10^{-4}$ wt %.

| Steel | C | Si | Mn | Mo | Ni | Cr | S | Cu | Ca | O |
|---|---|---|---|---|---|---|---|---|---|---|
| A | 0.048 | 0.42 | 1.50 | 0.29 | 8.05 | 17.03 | 0.30 | 1.5 | 10 | 53 |
| B | 0.051 | 0.38 | 1.49 | 0.29 | 8.03 | 17.05 | 0.30 | 0.5 | 51 | 110 |
| C | 0.030 | 0.43 | 1.50 | 0.31 | 8.10 | 17.04 | 0.30 | 1.5 | 44 | 118 |
| D | 0.049 | 0.45 | 1.48 | 0.28 | 8.02 | 17.11 | 0.39 | 1.5 | 14 | 57 |
| E | 0.052 | 0.19 | 1.51 | 0.30 | 8.07 | 17.03 | 0.30 | 1.5 | 62 | 134 |

The test consisted of a turning operation, without lubrication, with a feed of 0.25 mm/revolution, a depth of cut of 1.5 mm and a cutting speed of 700 m/min. The tool was periodically dismantled in order to measure the flank wear. The curves resulting from this test are shown in FIG. 1.

As shown by the results, reference steels A and B are unsuitable for this type of machining. After only a few minutes of turning, the tools machining these steels are destroyed, that is to say that either their flank wear is greater than 0.15 mm or their edge has collapsed. It is therefore unthinkable to use such cutting speeds for machining these steels. In contrast, with steel C according to the invention, the coated tool is still fit for machining after 20 minutes of turning, enabling conventional carbide-coated tools to work under industrial conditions at such cutting speeds. This is thought to be due to the combined presence in the composition of the steel of a large quantity of sulfur, low-melting-point malleable oxides and an optimum copper content.

Figure 2:
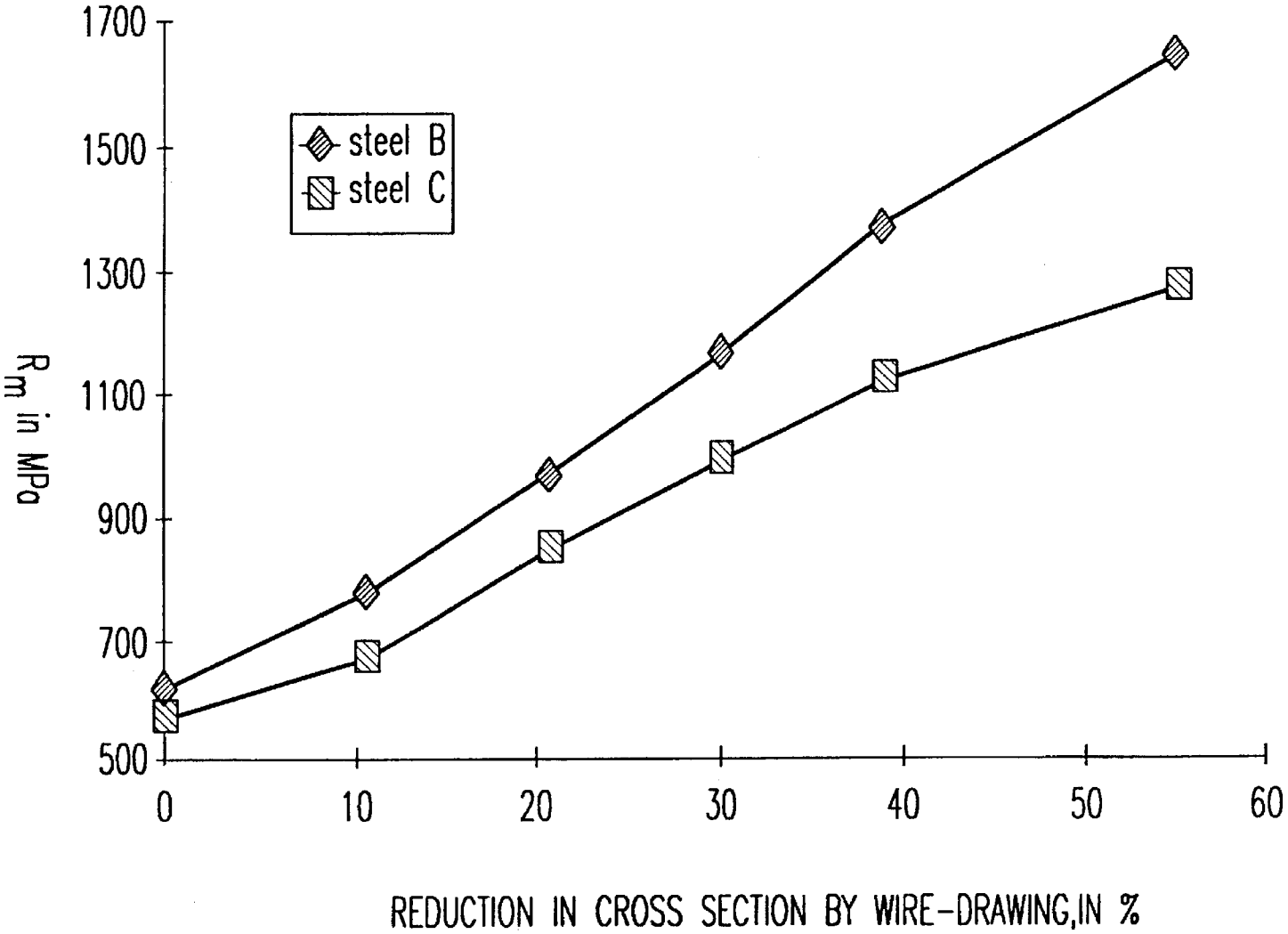
FIG. 2 shows the work-hardening curves of a copper-free resulfurized steel and a steel according to the invention.

In the use of the steel according to the invention in the bar-turning field, the machinability is believed to be improved by the presence of copper during the manufacture of bars, and then by the effect of the inclusions of manganese sulfide and of aluminosilicate oxides of lime during machining. Copper decreases the work-hardening, as shown in FIG. 2, in which once again reference steel B and steel C according to the invention are compared. This low work-hardening results in drawn bars being obtained with a lower hardness, in particular at the surface.

The effect of the inclusions apparently subsequently acts in a complementary fashion to promote shearing of the chip and to lubricate the tool/metal interface.

In a production test of bar-turning workpieces, the productivity of two resulfurized steels, referenced D and E, is compared. Reference steel D is a resulfurized steel which does not contain calcium or oxygen in a preferred proportion in its composition and steel E, according to the invention, in this embodiment, includes 1.5% of copper, $62\times10^{-4}$% of calcium and $134\times10^{-4}$% of oxygen in its composition.

Surprisingly, the combined action of the three elements, copper, oxygen and calcium, generates a particular effect on the improvement in machinability which is unpredictable when these elements are introduced into the composition in pairs or separately.

The compositions of reference steel D and steel E according to the invention are described above.

The test consists in producing, from a drawn bar 5 mm in diameter, a workpiece 50 mm in length, comprising essentially turning with a depth of cut varying from 0.5 to 1.5 mm. The table below shows the results of a bar-turning test on a single-spindle cam turning lathe with monobloc carbide tools and with neat-oil lubrication. The values in the table below represent the number of workpieces machined with good quality before tool change.

| Productivity | Steel D | Steel E |
|---|---|---|
| 1.82 workpieced/min | 3,200 | 6,000 |
| 2.30 workpieced/min | 1,500 | 3,200 |

Under the cutting conditions optimized for a reference steel, 2.5 times more workpieces may be produced with the steel according to the invention before having to change the tools. Conversely, with a 30% greater productivity for the steel according to the invention, the lifetime is the same.

In another bar-turning test, steels D and E are compared in a simple parting-off operation, consisting in producing bars 4 mm in diameter from rod stock cut off on a torch-type machine. The productivity was improved by 28% with steel E according to the invention compared to reference steel D which does not contain calcium or oxygen in a preferred proportion.

This application is based on French patent application 95 04 140 filed Apr. 7, 1995, incorporated herein by reference.

What is claimed as new a desired to be secured by Letters Patent of the United States is:

1. A resulfurized austenitic stainless steel comprising, by weight based on the total weight of the steel:

carbon<0.1% silicon<2% manganese<2% nickel, from 7 to 12% chromium, from 15 to 25% sulfur, from 0.10 to 0.55% copper, from 1 to 5% calcium>$35\times10^{-4}$% oxygen>$70\times10^{-4}$%, wherein the weight ratio of calcium to oxygen is from 0.2 to 0.6.

2. The steel as claimed in claim 1, wherein the sulfur is present in from 0.20 to 0.40%.

3. The steel as claimed in claim 1, wherein sulfur is present in from 0.25 to 0,35%.

4. The steel as claimed in claim 1, wherein copper is present in from 1.2 to 3%.

5. The steel as claimed in claim 1, wherein copper is present in from 1.4 to 1.8%.

6. The steel as claimed in claim 1, wherein the composition comprises less than 3 wt % of molybdenum based on the total weight of the composition.

7. A method of machining steel at a high speed, comprising the step of machining the steel of claim 1 at a cutting speed of greater than 500 m/min.

* * * * *